US011046543B2

(12) United States Patent
Tachi

(10) Patent No.: US 11,046,543 B2
(45) Date of Patent: Jun. 29, 2021

(54) WEB CONVEYANCE DEVICE WITH BRAKE

(71) Applicant: RISO KAGAKU CORPORATION, Tokyo (JP)

(72) Inventor: Manabu Tachi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 202 days.

(21) Appl. No.: 16/415,213

(22) Filed: May 17, 2019

(65) Prior Publication Data

US 2019/0389683 A1 Dec. 26, 2019

(30) Foreign Application Priority Data

Jun. 22, 2018 (JP) ..... JP2018-118484

(51) Int. Cl.
*B65H 23/185* (2006.01)
*B65H 16/10* (2006.01)

(52) U.S. Cl.
CPC ..... *B65H 23/185* (2013.01); *B65H 16/103* (2013.01); *B65H 2515/322* (2013.01)

(58) Field of Classification Search
None
See application file for complete search history.

(56) References Cited

U.S. PATENT DOCUMENTS 3,501,108 A * 3/1970 Roscoe ..... B65H 23/063 242/420.6
5,660,675 A * 8/1997 Boyd ..... B29C 65/7835 156/361
5,794,869 A * 8/1998 Takano ..... B65H 23/042 242/331.5
6,637,328 B1 * 10/2003 Berrigan ..... B41J 11/0085 101/226
2013/0028647 A1 * 1/2013 Okada ..... B65H 23/182 400/583
2013/0200836 A1 * 8/2013 Ishizuka ..... H02P 29/0241 318/494
2015/0115527 A1 * 4/2015 Takematsu ..... G03G 15/6576 271/265.01
2017/0001822 A1 * 1/2017 Asano ..... H02P 3/025
2017/0282602 A1 * 10/2017 Aoki ..... B41J 13/0009
2019/0100399 A1 * 4/2019 Inoue ..... B65H 23/1806
2019/0100400 A1 * 4/2019 Inoue ..... B65H 23/066
2019/0232635 A1 * 8/2019 Aoki ..... B41J 15/16
2019/0283472 A1 * 9/2019 Honda ..... B65H 23/00
2019/0389683 A1 * 12/2019 Tachi ..... B65H 23/185

FOREIGN PATENT DOCUMENTS

JP 2011-079651 A 4/2011

* cited by examiner

*Primary Examiner* — William A. Rivera
(74) *Attorney, Agent, or Firm* — Greenblum & Bernstein, P.L.C.

(57) ABSTRACT

A conveyance device includes: a conveyance mechanism configured to unwind and convey a web from a web roll; a brake configured to brake rotation of the web roll; a controller configured to perform control of gradually reducing a torque of the brake and then turning off the brake in an operation of turning off the brake in a state where conveyance of the web by the conveyance mechanism is stopped and the brake is on with a tension applied to the web between the web roll and the conveyance mechanism.

2 Claims, 5 Drawing Sheets

WEB CONVEYANCE DEVICE WITH BRAKE

CROSS REFERENCE TO RELATED APPLICATION

This application is based upon and claims the benefit of priority from the prior Japanese Patent Application No. 2018-118484, filed on Jun. 22, 2018, the entire contents of which are incorporated herein by reference.

BACKGROUND

1. Technical Field

The disclosure relates to a conveyance device which conveys a web.

2. Related Art

Japanese Patent Application Publication No. 2011-79651 proposes a printing apparatus which prints images on a long web being a print medium while conveying the web.

Moreover, there is a printing apparatus which prints images on a web by ejecting inks from inkjet heads while unwinding and conveying the web from a web roll, which is the web wound into a roll, and applying a brake to rotation of the web roll by using a brake mechanism. In this printing apparatus, appropriate tension for achieving excellent print image quality is applied to the web W by applying the brake to the rotation of the web roll.

In this printing apparatus, after the printing is completed and the conveyance of the web is stopped, the brake mechanism is maintained in an on state to apply the tension to the web and prevent slack in the web. However, when the brake mechanism is turned off in this state as a result of power-off of the printing apparatus, the web roll is rotated by the tension of the web to send out the web and slacken the web in some cases. When the web slackens, the web comes into contact with the inkjet heads and causes problems such as damaging of the inkjet heads in some cases.

SUMMARY

The aforementioned slack in the web can be prevented by providing a mechanism such as an external brake which prevents the web roll from rotating when the brake mechanism is turned off.

Providing the mechanism such as the external brake which prevents the web roll from rotating as described above leads to a complex device configuration.

The disclosure is directed to a conveyance device which can prevent slack in a web while avoiding a complex device configuration.

A conveyance device in accordance with some embodiments includes: a conveyance mechanism configured to unwind and convey a web from a web roll; a brake configured to brake rotation of the web roll; a controller configured to perform control of gradually reducing a torque of the brake and then turning off the brake in an operation of turning off the brake in a state where conveyance of the web by the conveyance mechanism is stopped and the brake is on with a tension applied to the web between the web roll and the conveyance mechanism.

The aforementioned configuration can prevent slack in the web while avoiding a complex device configuration.

DETAILED DESCRIPTION

Figure 1:
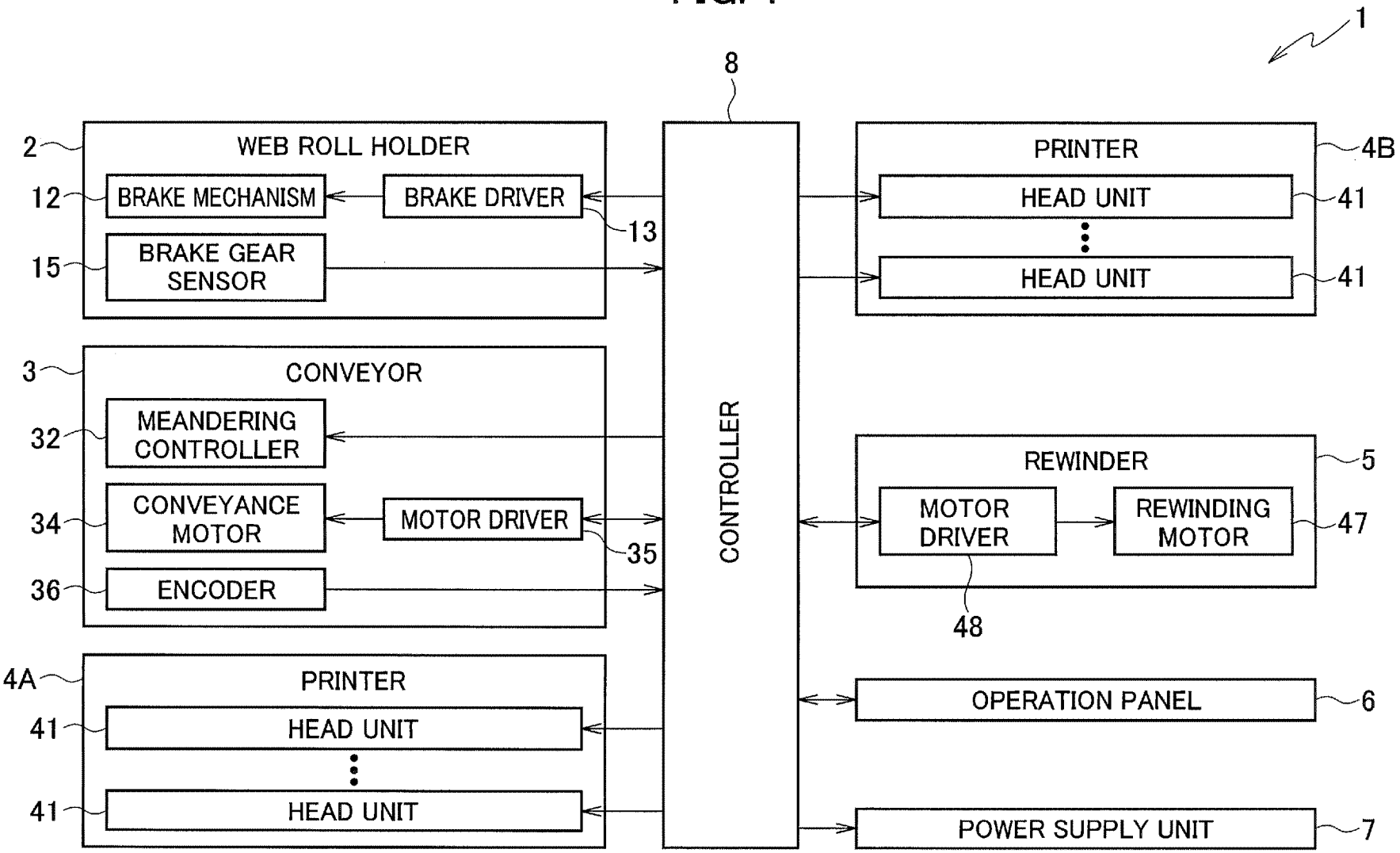
FIG. 1 is a block diagram illustrating a configuration of a printing apparatus according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
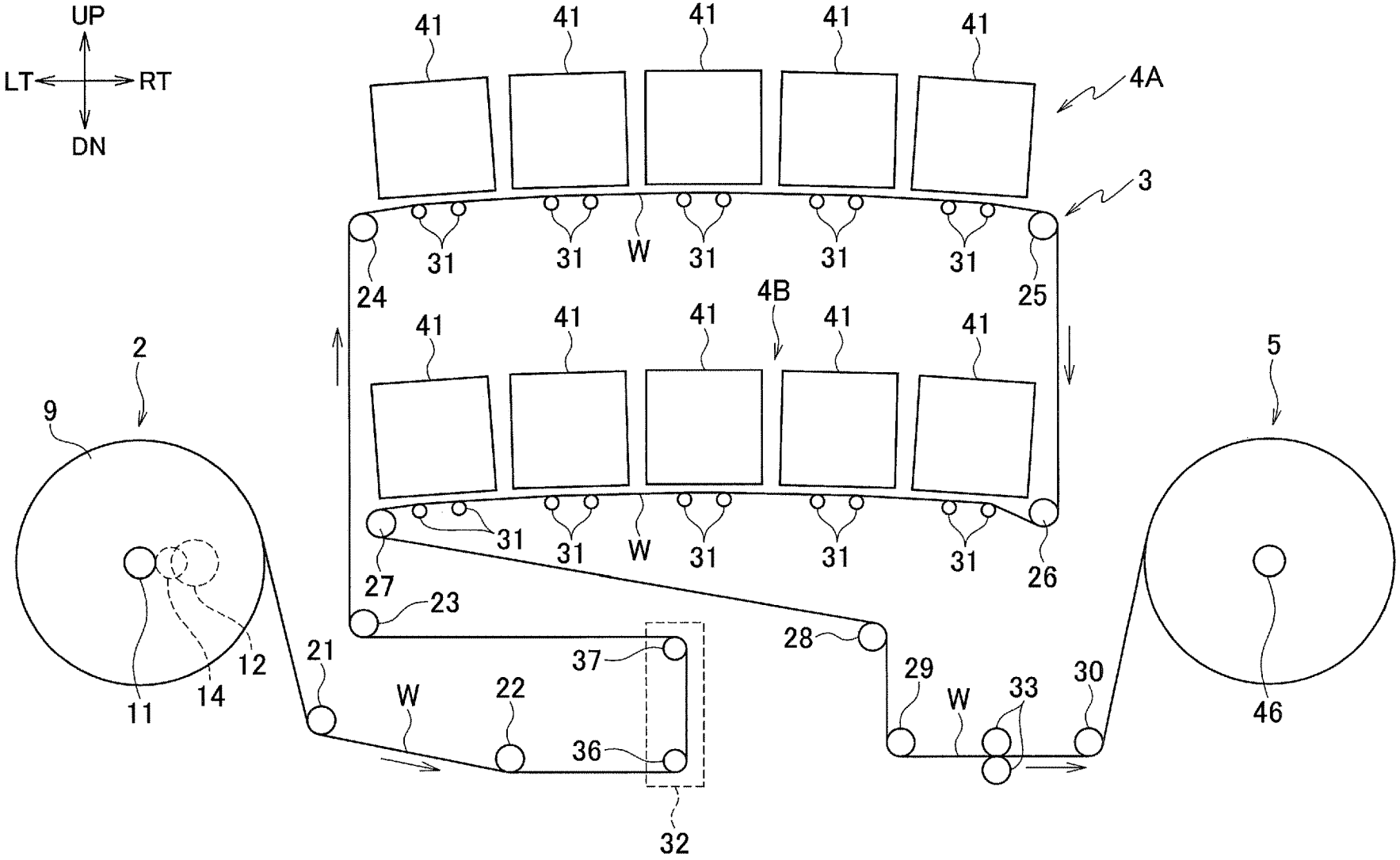
FIG. 2 is a schematic configuration of a main portion the printing apparatus illustrated in FIG. 1.
Figure 3:
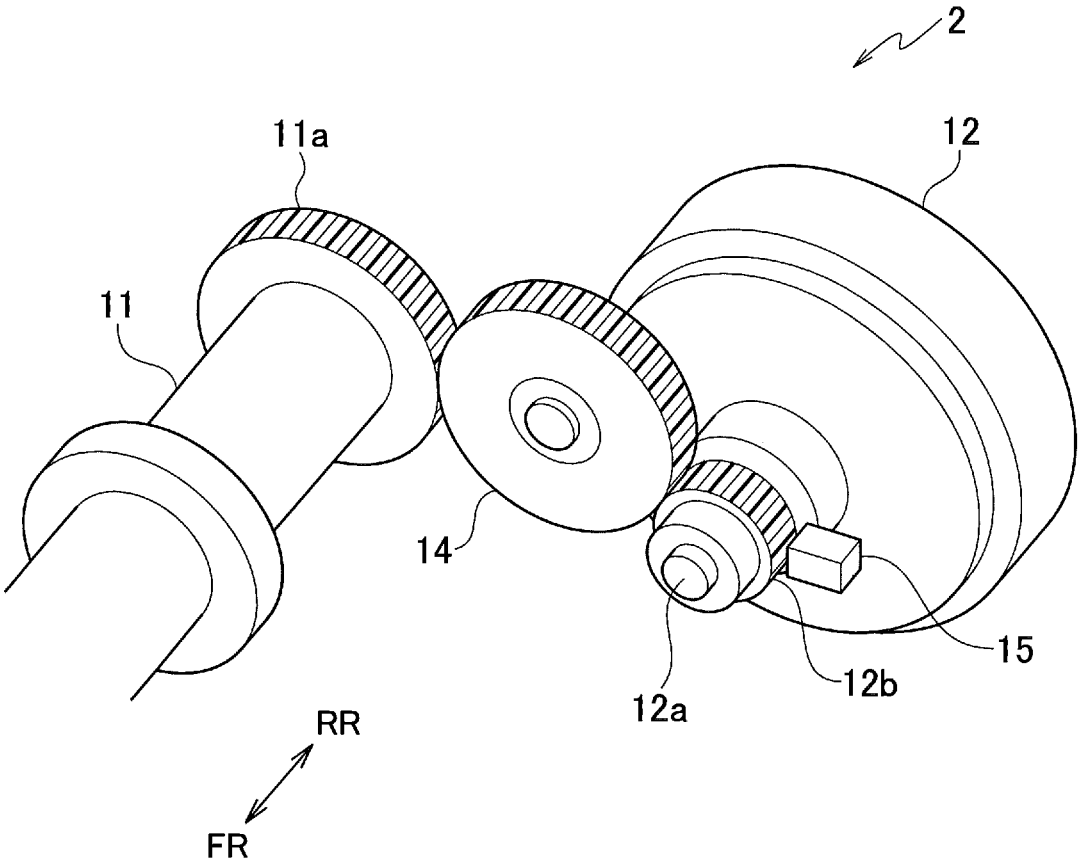
FIG. 3 is an enlarged perspective view of a main portion of a web roll holder in the printing apparatus illustrated in FIG. 1.

FIG. 1 is a block diagram illustrating a configuration of a printing apparatus 1 including a conveyance device according to an embodiment. FIG. 2 is a schematic configuration view of a main portion of the printing apparatus 1 illustrated in FIG. 1. FIG. 3 is an enlarged perspective view of a main portion of a web roll holder 2 in the printing apparatus 1 illustrated in FIG. 1. Note that, in the following direction, a direction orthogonal to the sheet surface of FIG. 2 is referred to as front-rear direction and a direction from the sheet surface toward the viewer is referred to as forward. Moreover, up, down, left, and right in the sheet surface of FIG. 2 is referred to as directions of up, down, left, and right. In FIGS. 2 and 3, the directions of right, left, up, down, front, and rear are denoted by RT, LT, UP, DN, FR, and RR, respectively.

As illustrated in FIG. 1, the printing apparatus 1 includes the web roll holder 2, a conveyor 3, printers 4A, 4B, a rewinder 5, an operation panel 6, a power supply unit 7, and a controller 8. The parts of the printing apparatus 1 other than the printers 4A, 4B form the conveyance device.

The web roll holder 2 holds a web roll 9. The web roll 9 is a web W wound into a roll and the web W is a long print medium made of film, paper, or the like. As illustrated in FIGS. 1 to 3, the web roll holder 2 includes a web roll support shaft 11, a brake mechanism 12, a brake driver 13, an intermediate gear 14, and a brake gear sensor 15.

The web roll support shaft 11 rotatably supports the web roll 9. The web roll support shaft 11 is formed in a long shape extending in a front-rear direction. The web roll support shaft 11 is formed of, for example, an air shaft. A web roll support shaft gear 11*a* meshing with the intermediate gear 14 is fixed to a rear end portion of the web roll support shaft 11.

The brake mechanism (brake) 12 is a mechanism which brakes rotation of the web roll 9 by braking rotation of the web roll support shaft 11. Specifically, the brake mechanism 12 applies brake torque (brake force) to the web roll support shaft 11, the brake torque being torque (load torque) in the opposite direction to a rotating direction (clockwise in FIG.

1) of the web W in unwinding. The brake mechanism 12 is formed of, for example, a powder brake.

The brake mechanism 12 includes an output shaft 12*a* which outputs the brake force. A brake gear 12*b* is attached to the output shaft 12*a*. The brake torque of the brake mechanism 12 is transmitted to the web roll support shaft 11 via the brake gear 12*b*, the intermediate gear 14, and the web roll support shaft gear 11*a* and the brake is thereby applied to the web roll support shaft 11.

The intermediate gear 14 transmits the brake torque of the brake mechanism 12 to the web roll support shaft gear 11*a*. The intermediate gear 14 meshes with the web roll support shaft gear 11*a* and the brake gear 12*b*.

The brake gear sensor 15 detects teeth of the brake gear 12*b*.

The conveyor 3 conveys the web W. The conveyor 3 includes guide rollers 21 to 30, twenty under-head rollers 31, a meandering controller 32, a pair of conveyance rollers (conveyance mechanism) 33, a conveyance motor 34, a motor driver 35, and an encoder 36.

The guide rollers 21 to 30 guide the web W conveyed in the conveyor 3. The guide rollers 21 to 30 rotate by following the conveyed web W. The guide rollers 21 to 30 are each formed in a long shape extending in the front-rear direction. The guide rollers 21 to 30, the under-head rollers 31, the conveyance rollers 33, and meandering control rollers 37, 38 of the meandering controller 32 to be described later forma conveyance route of the web W in the conveyor 3.

The guide rollers 21, 22 guide the web W between the web roll 9 and the meandering controller 32. The guide roller 21 is arranged near and on the right side of the web roll holder 2. The guide roller 22 is arranged between the guide roller 21 and the meandering control roller 37 of the meandering controller 32 to be described later.

The guide rollers 23 to 29 guide the web W between the meandering controller 32 and the pair of the conveyance rollers 33. The guide roller 23 is arranged slightly above and on the left side of the meandering control roller 38 of the meandering controller 32 to be described later. The guide roller 24 is arranged above the guide roller 23. The guide roller 25 is arranged on the right side of the guide roller 24 at the same height as the guide roller 24. The guide roller 26 is arranged below the guide roller 25 and above the guide roller 23. The guide roller 27 is arranged on the left side of the guide roller 26, near and on the right side of the web W between the guide rollers 23, 24, at substantially the same height as the guide roller 26. The guide roller 28 is arranged on the lower right side of the guide roller 27. The guide roller 29 is arranged below and slightly on the right side of the guide roller 28.

The guide roller 30 guides the web W between the pair of conveyance rollers 33 and the rewinder 5. The guide roller 30 is arranged near and on the left side of the rewinder 5.

The under-head rollers 31 support the web W below later-described head units 41 between the guide rollers 24 and 25 and between the guide rollers 26, 27. The under-head rollers 31 are each formed in a long shape extending in the front-rear direction. Ten under-head rollers 31 are arranged in each of an area between the guide rollers 24, 25 and an area between the guide rollers 26, 27. Moreover, two under-head rollers 31 are arranged directly below each head unit 41. The under-head rollers 31 rotate by following the conveyed web W.

The meandering controller 32 corrects meandering which is fluctuation in the position of the web Win the width direction thereof (front-rear direction). The meandering controller 32 includes the meandering control rollers 37, 38.

The meandering control rollers 37, 38 are rollers for guiding the web W and correcting the meandering of the web W. The meandering control rollers 37, 38 are each formed in a long shape extending in the front-rear direction. The meandering control rollers 37, 38 rotate by following the conveyed web W. The meandering control rollers 37, 38 are turned by a not-illustrated motor to be tilted with respect to the width direction of the web W as viewed in the left-right direction and thereby move the web W in the width direction to correct the meandering. The meandering control roller 37 is arranged on the right side of the guide roller 22. The meandering control roller 38 is arranged above the meandering control roller 37.

The pair of conveyance rollers 33 conveys the web W toward the rewinder 5 while nipping the web W. Conveyance of the web W by the conveyance rollers 33 causes the web roll 9 to rotate together with the web roll support shaft 11 and the web W is unwound from the web roll 9. One of the paired conveyance rollers 33 is rotationally driven by the conveyance motor 34 and the other conveyance roller 33 rotates by following the one conveyance roller 33. The pair of conveyance rollers 33 is arranged between the guide rollers 29, 30.

The conveyance motor 34 rotationally drives one of the paired conveyance rollers 33.

The motor driver 35 drives the conveyance motor 34.

The encoder 36 outputs a pulse signal every time an output shaft of the conveyance motor 34 rotates by a predetermined angle.

The printers 4A, 4B print images respectively on a front side and a back side of the web W. The printer 4A is arranged near and above the web W between the guide rollers 24, 25. The printer 4B is arranged near and above the web W between the guide rollers 26, 27. Each of the printers 4A, 4B includes five head units 41.

The head units 41 include inkjet heads (not illustrated) and print images by ejecting inks from nozzles of the inkjet heads to the web W. In each of the printers 4A, 4B, the five head units 41 eject inks of different colors, respectively.

The rewinder 5 rewinds the web W subjected to printing in the printers 4A, 4B. The rewinder 5 includes a rewinding shaft 46, a rewinding motor 47, and a motor driver 48.

The rewinding shaft 46 rewinds and holds the web W. The rewinding shaft 46 is formed in a long shape extending in the front-rear direction.

The rewinding motor 47 rotates the rewinding shaft 46 clockwise in FIG. 1. Rotation of the rewinding shaft 46 causes the web W to be rewound on the rewinding shaft 46.

The motor driver 48 drives the rewinding motor 47.

The operation panel 6 displays various input screens and the like and receives input operations made by a user. The operation panel 6 includes a display unit (not illustrated) having a liquid crystal display panel and the like and an input portion (not illustrated) having various operation keys, a touch panel, and the like.

The power supply unit 7 supplies electric power to parts of the printing apparatus 1.

The controller 8 controls operations of the entire printing apparatus 1. The controller 8 includes a CPU, a RAM, a ROM, a hard disk drive, and the like.

When in the operation of printing, the controller 8 performs control such that the conveyor 3 unwinds and conveys the web W from the web roll 9 and the rewinder 5 rewinds the web W while the brake is applied to the rotation of the web roll 9 by using the torque of the brake mechanism 12 to apply tension to the web W. Then, the controller 8 prints images by causing the inks to be ejected from the head units 41 of the printers 4A, 4B to the conveyed web W.

Moreover, in an operation of turning off the brake mechanism 12 in a state where the conveyance of the web W by the conveyance rollers 33 is stopped and the brake mechanism 12 is on to apply tension to the web W between the web roll 9 and the pair of conveyance rollers 33, the controller 8 performs control of turning off the brake mechanism 12 by performing brake torque gradual reduction processing. The brake torque gradual reduction processing is processing of gradually reducing the torque of the brake mechanism 12 and turning off the brake mechanism 12. Specifically, for example, in the operation of powering off the printing apparatus 1 in a standby state where the conveyance of the web W is stopped and the brake mechanism 12 is on to apply tension to the web W between the web roll 9 and the pair of conveyance rollers 33, the controller 8 turns off the brake mechanism 12 by performing the brake torque gradual reduction processing and then turns off the power.

The controller 8 stores a brake torque reduction rate table (not illustrated). The brake torque reduction rate table is a table in which motor torque, the type of the web W, the width of the web W, and a reduction rate of the brake torque are associated with one another. The brake torque reduction rate table is used to set (determine) the reduction rate of the brake torque in the brake torque gradual reduction processing.

The motor torque is torque of the conveyance motor 34. The motor torque corresponds to the tension of the web W at the position of the conveyance rollers 33. The types of the web W include a thick paper, a thin paper, and the like. The reduction rate of the brake torque is a reduction amount of the brake torque per unit time.

In the brake torque reduction rate table, the reduction rate of the brake torque depending on the type and width of the web W is set in advance for each range of a value of the motor torque at the start of the brake torque gradual reduction processing. If the type and width of the web W are the same, the higher the motor torque at the start of the brake torque gradual reduction processing is, the lower the reduction rate of the brake torque is set. Moreover, if the motor torque at the start of the brake torque gradual reduction processing and the width of the web W are the same, the more stretchable the type of the web W is, the lower the reduction rate of the brake torque is set. Furthermore, if the motor torque at the start of the brake torque gradual reduction processing and the type of the web W are the same, the greater the width of the web W is, the lower the reduction rate of the brake torque is set.

The higher the motor torque is, the higher the tension of the web W is and the greater is the risk that, if the brake torque is rapidly reduced, the tension in the web W is still present when the brake torque reaches zero and causes the web roll 9 to rotate, thereby slackening the web W. Accordingly, the higher the motor torque at the start of the brake torque gradual reduction processing is, the lower the reduction rate of the brake torque is set to slowly reduce the brake torque.

Moreover, the more stretchable the web W, the greater the risk that, if the brake torque is rapidly reduced, the greatly-stretched web W is rapidly unstretched and the rapid unstretching vigorously rotates the web roll 9, thereby slackening the web W. Accordingly, the more stretchable the type of the web W is, the lower the reduction rate of the brake torque is set to slowly reduce the brake torque.

Furthermore, if the type of the web and the length of the web W remaining in the web roll 9 are the same, the larger the width of the web W is, the heavier the web roll 9 is. The heavier the web roll 9 is, the less likely the rotation of the web roll 9 is to stop once it starts to rotate due to large inertia and the more likely the web W is to slacken. In other words, the greater the width of the web W is, the more likely the web W is to slacken, if the other factors are the same. Accordingly, the greater the width of the web W is, the lower the reduction rate of the brake torque is set to slowly reduce the brake torque.

Next, operations in printing of the printing apparatus 1 are described.

When a print job is inputted, the controller 8 starts drive of the conveyance motor 34 and the rewinding motor 47 to start the conveyance of the web W.

In this example, the web roll 9 is assumed to be a roll continuously used after the completion the previous print job. Moreover, the power of the printing apparatus 1 is assumed to be left on after the completion the previous print job. In this case, the brake mechanism 12 is left on after the completion the previous print job and a value of brake torque T at the completion the previous print job is set.

When the conveyance of the web W is started, the controller 8 increases speed of conveyance of the web W by the conveyance rollers 33 at a predetermined acceleration, from the start of conveyance.

Then, when the speed of conveyance of the web W by the conveyance rollers 33 reaches a predetermined print conveyance speed Vg, the controller 8 controls the conveyance motor 34 and the rewinding motor 47 such that the conveyance transitions to constant speed conveyance of the web W at the print conveyance speed Vg from this moment.

After the start of the constant speed conveyance of the web W at the print conveyance speed Vg, the controller 8 starts printing based on the print job by using the printers 4A, 4B.

After the start of the constant speed conveyance of the web W at the print conveyance speed Vg, the controller 8 controls the conveyance motor 34 such that the conveyance speed of the web W is maintained to be constant at the print conveyance speed Vg, based on the output pulse signal of the encoder 36. The conveyance speed of the web W is maintained to be constant to prevent deviation of landing positions of the inks ejected from the head units 41 to the web W and achieve excellent print image quality.

Specifically, the controller 8 calculates the number of revolutions of the conveyance motor 34 based on the output pulse signal of the encoder 36 and calculates the conveyance speed of the web W corresponding to the calculated number of revolutions. Then, the controller 8 controls the conveyance motor 34 such that the difference between the calculated conveyance speed and the print conveyance speed Vg is eliminated. The speed of conveyance of the web W by the conveyance motor 34 is thereby controlled to match the print conveyance speed Vg.

Moreover, during the conveyance of the web W, the controller 8 controls the brake torque T of the brake mechanism 12 depending on the outer diameter D of the web roll 9 such that the tension of the web W is maintained at set tension F.

At the start of the constant speed conveyance of the web W at the print conveyance speed Vg, a decrease amount of the outer diameter D of the web roll 9 from the start of conveyance of the web W is small. In other words, the outer diameter D of the web roll is substantially constant until the start of the constant speed conveyance of the web W at the print conveyance speed Vg. Accordingly, the brake torque T of the brake mechanism 12 is set to the value at the completion the previous print job which is the value at the start of conveyance of the web W, until the start of the constant speed conveyance of the web W at the print conveyance speed Vg.

However, the outer diameter D of the web roll 9 gradually decreases with lapse of time from the start of conveyance of web W. Accordingly, the controller 8 calculates the outer diameter D of the web roll 9 in real time and sets the brake torque of the brake mechanism 12 to the brake torque T depending on the calculation result in real time, in the period of the constant speed conveyance of the web W at the print conveyance speed Vg.

Specifically, the controller 8 calculates the number of revolutions of the brake mechanism 12 (number of revolution of the brake gear 12*b*) in real time based on an output signal of the brake gear sensor 15 and converts the calculated number of revolutions into the number of revolution N of the web roll 9. Then, the controller 8 calculates the outer diameter D of the web roll 9 based on the following formula (1) by using the number of revolution N of the web roll 9 and the print conveyance speed Vg.

$$D=Vg/(N\times\pi) \quad (1)$$

Then, the controller 8 calculates the brake torque T depending on the outer diameter D of the web roll 9 by using the following formula (2) and sets the brake torque of the brake mechanism 12 to the calculated brake torque T.

$$T=F\times D/(2\times Gb) \quad (2)$$

In this formula, Gb is a reduction ratio (gear ratio) between the brake mechanism 12 and the web roll support shaft 11.

As described above, the brake torque T is changed in real time depending on the decrease of the outer diameter D of the web roll 9 to maintain the tension of the web W at the set tension F.

When the printing based on the print job is completed, the controller 8 stops the conveyance motor 34 and the rewinding motor 47 and terminates the conveyance of the web W. The series of operations in printing is thereby completed.

The brake mechanism 12 is maintained in the on state after the completion of the printing operation. In this case, the brake torque T is maintained at the value at the completion of the conveyance of the web W. Maintaining the on state of the brake mechanism 12 after the completion of the printing operation prevents the web W from slackening due to free rotation of the web roll 9 and coming into contact with the inkjet heads of the head units 41.

In the case where the web roll 9 is continuously used without being removed after the print operation is completed, the brake torque at the start of conveyance of the web W to perform a print operation based on the next print job is set to the same value as the brake torque at the completion of the previous print operation. This is because the outer diameter D of the web roll 9 at the start of the print operation based on the next print job is the same as the outer diameter D of the web roll 9 at the completion of the previous print operation.

When the web roll 9 is replaced and the print operation based on the print job is to be performed by using a new web roll 9, conveyance of the web W for roll diameter calculation (calculation of the outer diameter D of the web roll 9) is performed before the start of the print operation.

In the conveyance of the web W for roll diameter calculation, the controller 8 causes the web W to be conveyed at roll diameter calculation conveyance speed Vc slower than the print conveyance speed Vg. In this case, the controller 8 sets the brake torque to a predetermined initial value.

During the conveyance of the web W at the roll diameter calculation conveyance speed Vc, the controller 8 calculates the number of revolutions N of the web roll 9 based on the output signal of the brake gear sensor 15. Then, the controller 8 calculates the outer diameter D of the web roll 9 by using the following formula (3).

$$D=Vc/(N\times\pi) \quad (3)$$

After calculating the outer diameter D of the web roll 9, the controller 8 calculates the brake torque T depending on the calculated outer diameter D by using the aforementioned formula (2). Then, the controller 8 sets the brake torque of the brake mechanism 12 to the calculated brake torque T and terminates the conveyance of the web W for roll diameter calculation. Thereafter, the controller 8 executes the aforementioned print operation.

Next, a power off operation including the brake torque gradual reduction processing is described with reference to the flowchart of FIG. 4.

The power off operation of the printing apparatus 1 is performed in response to a power off instruction made by the user when the printing apparatus 1 is in the standby state. In the printing apparatus 1, the standby state is a state where the conveyance of the web W by the conveyance rollers 33 is stopped and the brake mechanism 12 is on and tension is applied to the web W between the web roll 9 and the pair of conveyance rollers 33.

Figure 4:
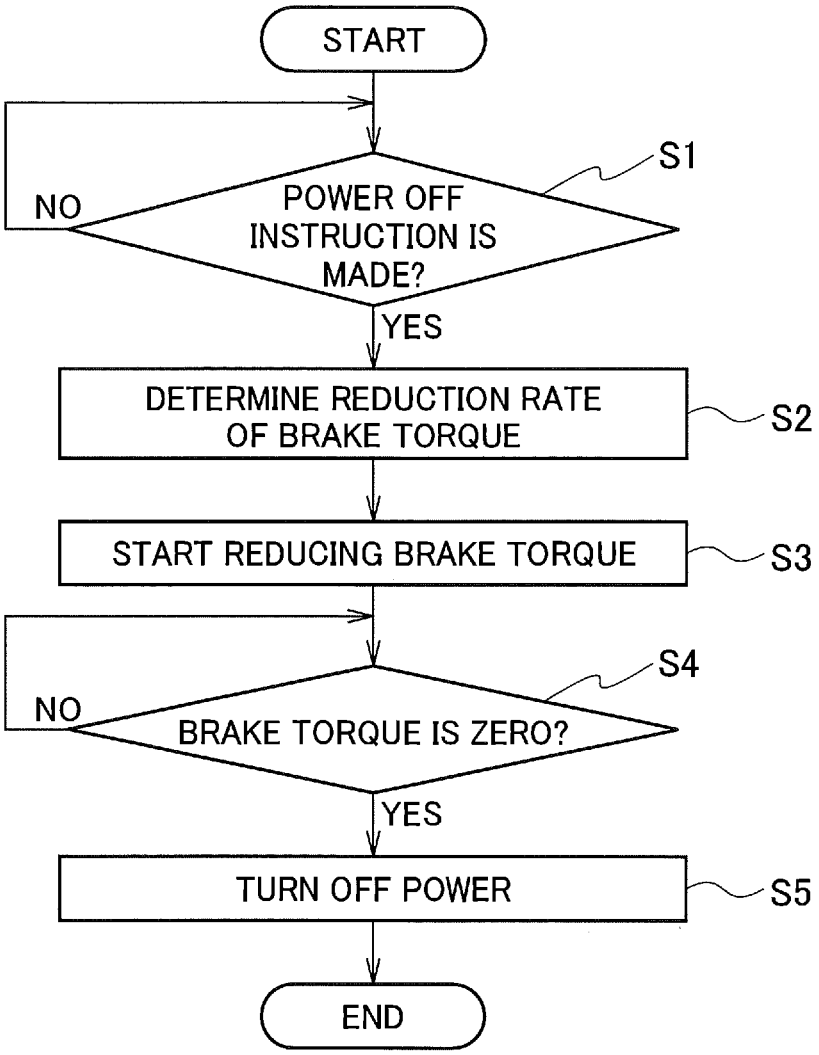
FIG. 4 is a flowchart for explaining a power off operation including brake torque gradual reduction processing.

In step S1 of FIG. 4, the controller 8 determines whether the power off instruction is made or not. The power off instruction is made by the user operating the operation panel 6. When the controller 8 determines that the power off instruction is not made (step S1: NO), the controller 8 repeats step S1.

When the controller 8 determines that the power off instruction is made (step S1: YES), in step S2, the controller 8 determines the reduction rate of the brake torque in the brake torque gradual reduction processing.

Specifically, the controller 8 obtains the value of the current motor torque from the motor driver 35. Then, the controller 8 refers to the brake torque reduction rate table and determines the reduction rate of the brake torque based on the motor torque, the type of the web W, and the width of the web W. The type and width of the web W are obtained from job data of the print job in the latest print operation.

Figure 5:
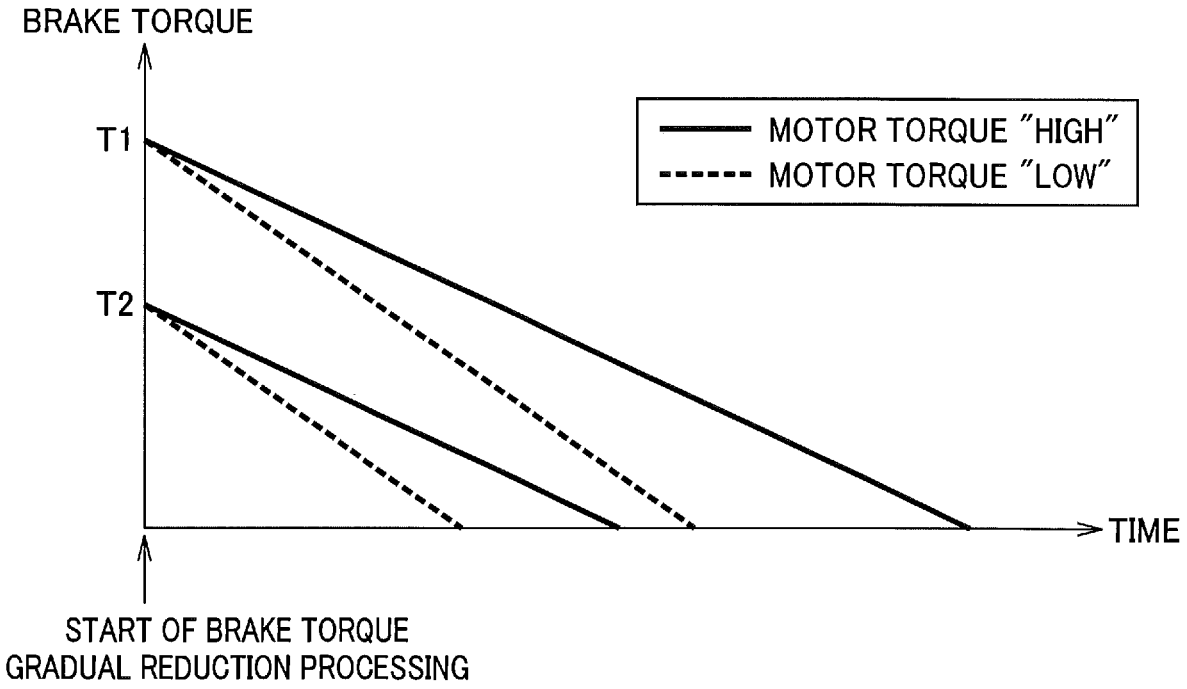
FIG. 5 is a view illustrating changes in brake torque in the brake torque gradual reduction processing.

Next, in step S3, the controller 8 starts reducing the brake torque. Specifically, the controller 8 starts the brake torque gradual reduction processing. Then, the controller 8 gradually reduces the brake torque as illustrated in FIG. 5. In this case, the controller 8 reduces the brake torque at the reduction rate determined in step S2.

FIG. 5 illustrates changes in the brake torque in the cases where the motor torque at the start of the brake torque gradual reduction processing is "high" and "low" in each of the cases where the outer diameter D of the web roll 9 at the start of the brake torque gradual reduction processing is "large" and "small." Note that, in the example of FIG. 5, the type and width of the web W are assumed to be the same in all cases.

As apparent from the aforementioned formula (2), the brake torque T is proportional to the outer diameter D of the web roll 9. Accordingly, in FIG. 5, the cases where the brake torque at the start of the brake torque gradual reduction processing is T1 correspond to the cases where the outer diameter D of the web roll 9 is "large" and the cases where the brake torque is T2 correspond to the cases where the outer diameter D of the web roll 9 is "small."

As illustrated in FIG. 5 and as described above, the higher the motor torque at the start of the brake torque gradual reduction processing is, the lower the reduction rate of the brake torque is set.

As described above, the motor torque corresponds to the tension of the web W at the position of the conveyance rollers 33. As described above, the tension of the web W is controlled to be the set tension F by setting the brake torque T depending on the outer diameter D of the web roll 9. However, since the degree of stretching of the web W and the like vary depending on the type of the web W and the like, the actual tension of the web W at the position of the conveyance rollers 33 is sometimes different from the set tension F. Accordingly, in the embodiment, the reduction rate of the brake torque in the brake torque gradual reduction processing is adjusted by using the motor torque which corresponds to the tension of the web W at the position of the conveyance rollers 33 at the start of the brake torque gradual reduction processing as described above.

Returning to FIG. 4, in step S4, the controller 8 determines whether the brake torque has reached zero. When the controller 8 determines the brake torque has not reached zero yet (step S4: NO), the controller 8 repeats step S4.

In this case, when the brake torque reaches zero, the brake mechanism 12 is turned off and the brake torque gradual reduction processing is terminated. When the controller 8 determines that the brake torque has reached zero (step S4: YES), in step S5, the controller 8 turns the power off. Specifically, the controller 8 causes the power supply unit 7 to stop supply of power to the parts of the printing apparatus 1. The power off operation including the brake torque gradual reduction processing is thus completed.

Note that, in the printing apparatus 1, the controller 8 turns off the brake mechanism 12 by performing the brake torque gradual reduction processing not only when the power is turned off as described above but also when, for example, the conveyance of the web W is stopped and the brake mechanism is turned off because abnormality is expected to occur.

Specifically, the controller 8 sometimes stops the conveyance of the web W by the conveyance rollers 33 and turns off the brake mechanism 12 because conveyance abnormality caused by abnormality in the conveyance motor 34 or abnormality of the web W being unwound from the web roll 9 to the limit is expected to occur. In such cases, the controller 8 turns off the brake mechanism 12 by performing the brake torque gradual reduction processing as described above. When the expected abnormality is avoided, the controller 8 sets the brake torque of the brake mechanism 12 to the brake torque at the stop of the conveyance and restart the conveyance of the web W.

As described above, in the printing apparatus 1, in the operation of turning off the brake mechanism 12 in the state where the conveyance of the web W by the conveyance rollers 33 is stopped and the brake mechanism 12 is on to apply tension to the web W between the web roll 9 and the pair of conveyance rollers 33, the controller 8 turns off the brake mechanism 12 by performing the brake torque gradual reduction processing to gradually reduce the torque of the brake mechanism 12. The brake mechanism 12 is thereby turned off with the tension of the web W gradually released. This prevents the web W from slackening due to rotation of the web roll 9.

Moreover, since there is no need to provide a mechanism such as an external brake to prevent the rotation of the web roll 9, it is possible to avoid a complex device configuration and an increase in cost.

Accordingly, the printing apparatus 1 can prevent slack in the web W while avoiding a complex device configuration.

Moreover, the controller 8 sets the reduction rate of the brake torque in the brake torque gradual reduction processing depending on the motor torque at the start of the brake torque gradual reduction processing, the type of the web W, and the width of the web W. The reduction rate of the brake torque in the brake torque gradual reduction processing can be thereby appropriate set depending on the tension of the web W and the like. Accordingly, slack in the web W can be further prevented.

Note that, although three factors which are the motor torque at the start of the brake torque gradual reduction processing, the type of the web W, and the width of the web W are used to determine the reduction rate of the brake torque in the brake torque gradual reduction processing in the aforementioned embodiment, one or two of these three factors may be omitted. Moreover, it is possible to use a predetermined reduction rate set in advance without using any of these factors.

Moreover, although the motor torque at the start of the brake torque gradual reduction processing is used as the torque corresponding to the tension of the web W to determine the reduction rate of the brake torque in the brake torque gradual reduction processing in the aforementioned embodiment, the set tension F may be used. Moreover, both of the set tension F and the tension of the web W calculated from the motor torque at the start of the brake torque gradual reduction processing may be used. For example, an average value of the set tension F and the calculated tension may be used.

The embodiments of the disclosure have, for example, the following configurations.

A conveyance device includes: a conveyance mechanism configured to unwind and convey a web from a web roll; a brake configured to brake rotation of the web roll; a controller configured to perform control of gradually reducing a torque of the brake and then turning off the brake in an operation of turning off the brake in a state where conveyance of the web by the conveyance mechanism is stopped and the brake is on with a tension applied to the web between the web roll and the conveyance mechanism.

The controller may be configured to determine a reduction rate of the torque of the brake depending on at least one of a tension of the web at start of reduction of the torque of the brake, a type of the web, and a width of the web.

The conveyance mechanism may include a pair of rollers.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A conveyance device comprising:

a conveyance mechanism configured to unwind and convey a web from a web roll;

a brake configured to brake rotation of the web roll; and a controller configured to perform control of gradually reducing a torque of the brake and then turning off the brake in an operation of turning off the brake in a state where conveyance of the web by the conveyance mechanism is stopped and the brake is on with a tension applied to the web between the web roll and the conveyance mechanism, wherein the controller is configured to determine a reduction rate of the torque of the brake depending on at least one of a tension of the web at start of reduction of the torque of the brake, a type of the web, and a width of the web.

2. The conveyance device according to claim 1, wherein the conveyance mechanism comprises a pair of rollers.

* * * * *